US010438546B2

(12) United States Patent
Yang et al.

(10) Patent No.: US 10,438,546 B2
(45) Date of Patent: Oct. 8, 2019

(54) CIRCUIT FOR REMOVING RESIDUAL IMAGE AFTER POWER-OFF, METHOD FOR DRIVING SAME, AND DISPLAY APPARATUS

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Yuting Yang, Beijing (CN); Lingxiao Hu, Beijing (CN); Chun Ye, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 15/552,286

(22) PCT Filed: Feb. 6, 2017

(86) PCT No.: PCT/CN2017/072951
§ 371 (c)(1),
(2) Date: Aug. 20, 2017

(87) PCT Pub. No.: WO2017/215274
PCT Pub. Date: Dec. 21, 2017

(65) Prior Publication Data

US 2018/0240414 A1 Aug. 23, 2018

(30) Foreign Application Priority Data

Jun. 17, 2016 (CN) ..... 2016 1 0440549

(51) Int. Cl.
*G09G 3/36* (2006.01)
*G09G 3/20* (2006.01)

(52) U.S. Cl.
CPC ..... *G09G 3/36* (2013.01); *G09G 3/20* (2013.01); *G09G 3/3648* (2013.01); *G09G 2320/0257* (2013.01); *G09G 2330/027* (2013.01)

(58) Field of Classification Search
CPC ..... G09G 3/36; G09G 3/3618; G09G 3/3614; G09G 3/3648; G09G 2330/02; G09G 2330/027
See application file for complete search history.

(56) References Cited

U.S. PATENT DOCUMENTS 7,825,919 B2 * 11/2010 Woo ..... G09G 3/3648 345/211

FOREIGN PATENT DOCUMENTS

| | | | |
|---|---|---|---|
| CN | 1447306 | A | 10/2003 |
| CN | 101546536 | A | 9/2009 |
| CN | 102522070 | A | 6/2012 |
| CN | 104091569 | A | 10/2014 |
| CN | 105513549 | A | 4/2016 |
| CN | 105845069 | A | 8/2016 |

OTHER PUBLICATIONS

International Search Report & Written Opinion, for PCT Patent Application No. PCT/CN2017/072951, dated May 9, 2017, 21 pages.

(Continued)

*Primary Examiner* — Ram A Mistry
(74) *Attorney, Agent, or Firm* — Kinney & Lange, P.A.

(57) ABSTRACT

The embodiments of the present disclosure provide a circuit for removing residual image after power-off, a method for driving the circuit, and a display apparatus. The circuit comprises a comparator, a control circuit and an output circuit. The comparator is configured to output a high level voltage when a voltage at its non-inverting terminal is higher (Continued)

than a voltage at its inverting terminal, or output a low level voltage when the input voltage at its non-inverting terminal is lower than or equal to the input voltage at its inverting terminal. The control circuit is configured to align a voltage at the control node with a voltage at the second level terminal when the comparator outputs the high level voltage, and align the voltage at the control node with a voltage at the third level terminal when the comparator outputs the low level voltage. The output circuit is configured to output a voltage of the fourth level terminal at the signal output terminal when the voltage at the control node is the voltage at the third level terminal, and output a voltage of the fifth level terminal at the signal output terminal when the voltage at the control node is the voltage at the second level terminal.

19 Claims, 4 Drawing Sheets

(56) References Cited

OTHER PUBLICATIONS

International Search Report & Written Opinion, for PCT Patent Application No. PCT/CN2017/072951, dated May 9, 2017, 24 pages.

* cited by examiner

CIRCUIT FOR REMOVING RESIDUAL IMAGE AFTER POWER-OFF, METHOD FOR DRIVING SAME, AND DISPLAY APPARATUS

CROSS REFERENCE TO RELATED APPLICATIONS

The present disclosure is the U.S. national phase application of the international application PCT/CN2017/072951, entitled "CIRCUIT FOR REMOVING RESIDUAL IMAGE AFTER POWER-OFF, METHOD FOR DRIVING SAME, AND DISPLAY APPARATUS" and filed on Feb. 6, 2017, and claims a benefit from Chinese Patent Application No. 201610440549.1, titled "CIRCUIT FOR REMOVING RESIDUAL IMAGE AFTER POWER-OFF, METHOD FOR DRIVING SAME, AND DISPLAY APPARATUS" and filed on Jun. 17, 2016, both of which are incorporated here by reference in their entirety.

TECHNICAL FIELD

The present disclosure relates to display technology, and more particularly, to a circuit for removing residual image after power-off, a method for driving the circuit, and a display apparatus.

BACKGROUND

When a display is powered off, a portion of the image displayed right before power-off will remain. This is because, when the display is in a normal lighted state, there is a certain amount of charge on a pixel electrode of each pixel. If the charges on the pixel electrode vanish gradually, instead of being removed timely upon power-off, a user may still perceive the image on the display. This phenomenon is called residual image after power-off. In order to solve the problem of residual image after power-off, it has been proposed that an output terminal of a main power supply of an analog circuit in the display may be connected to a gate driving chip and serves as a control signal for controlling the output from the gate driving circuit. When the display is operating normally, the control signal is at a high level and the gate driving circuit scans respective gate lines on a per-line basis in response to the control signal. Thin Film Transistors (TFTs) in the pixels in the respective lines are turned on sequentially and the display operates normally. When the display is powered off, the output voltage from the main power supply of the analog circuit decreases gradually. When the output voltage becomes lower than a predetermined value, the control signal is at a low level. In response to the control signal, the gate driving circuit turns on the TFTs in all the pixels and the charges in the pixel electrodes are conducted via the respective TFTs. The charges in the respective pixel electrodes are neutralized with each other, such that the phenomenon of residual image after power-off may be eliminated. However, the control signal inputted to the gate driving circuit is at the low level when the display is turned off, which may pull down the output voltage from the gate driving circuit and in turn cause TFTs of some pixels to be turned off after being turned on. In this case, the charges in the pixel electrodes cannot be removed timely, resulting in a degraded performance of removal of residual image after power-off.

SUMMARY

The embodiments of the present disclosure provide a circuit for removing residual image after power-off, a method for driving the circuit, and a display apparatus.

In a first aspect of the present disclosure, a circuit for removing residual image after power-off is provided. The circuit comprises: a comparator having an inverting terminal connected to a first level terminal and a non-inverting terminal connected to a control voltage input terminal, and configured to output a high level voltage at its output terminal when an input voltage at the non-inverting terminal is higher than an input voltage at the inverting terminal, or output a low level voltage at its output terminal when the input voltage at the non-inverting terminal is lower than or equal to the input voltage at the inverting terminal; a control circuit connected to a second level terminal, a third level terminal, a control node and the output terminal of the comparator, and configured to align a voltage at the control node with a voltage at the second level terminal when the output terminal of the comparator outputs the high level voltage, and align the voltage at the control node with a voltage at the third level terminal when the output terminal of the comparator outputs the low level voltage; and an output circuit connected to a fourth level terminal, a fifth level terminal, a signal output terminal and the control node, and configured to output a voltage of the fourth level terminal at the signal output terminal when the voltage at the control node is the voltage at the third level terminal, and output a voltage of the fifth level terminal at the signal output terminal when the voltage at the control node is the voltage at the second level terminal. The voltage of the fourth level terminal is the high level voltage and the voltage of the fifth level terminal is the low level voltage.

Optionally, the circuit further comprises: a voltage divider circuit connected to an input voltage terminal, the second level terminal and the control voltage input terminal, and configured to adjust the voltage at the control voltage input terminal.

Optionally, the circuit further comprises: a filter circuit connected to the control node and the second level terminal, and configured to filter the voltage at the control node.

Optionally, the control circuit comprises: a first transistor having its first terminal connected to the control node and the third level terminal, its second terminal connected to the second level terminal, and its gate connected to the output terminal of the comparator.

Optionally, the output circuit comprises a second transistor and a third transistor. The second transistor has its first terminal connected to the fourth level terminal, its second terminal connected to the signal output terminal, and its gate connected to the control node. The third transistor has its first terminal connected to the signal output terminal, its second terminal connected to the fifth level terminal, and its gate connected to the control node. The second transistor is an N-type transistor and the third transistor is a P-type transistor.

Optionally, the output circuit comprises an inverter circuit, a fourth transistor and a fifth transistor. The inverter circuit has its input terminal connected to the control node and its output terminal connected to the gate of the fourth transistor, and is configured to output a voltage at its output terminal that has an opposite phase to a voltage inputted at its input terminal. The fourth transistor has its first terminal connected to the fourth level terminal, its second terminal connected to the signal output terminal, and its gate connected to the output terminal of the inverter circuit. The fifth transistor has its first terminal connected to the signal output terminal, its second terminal connected to the fifth level terminal, and its gate connected to the control node. Each of the fourth and fifth transistors is a P-type transistor.

Optionally, the inverter circuit comprises an inverter or an OR gate.

Optionally, the output circuit comprises an inverter circuit, a fourth transistor and a fifth transistor. The inverter circuit has its input terminal connected to the control node and its output terminal connected to the gate of the fifth transistor, and is configured to output a voltage at its output terminal that has an opposite phase to a voltage inputted at its input terminal. The fourth transistor has its first terminal connected to the fourth level terminal, its second terminal connected to the signal output terminal, and its gate connected to the control node. The fifth transistor has its first terminal connected to the signal output terminal, its second terminal connected to the fifth level terminal, and its gate connected to the output terminal of the inverter circuit. Each of the fourth and fifth transistors is an N-type transistor.

Optionally, the inverter circuit comprises an inverter or an OR gate.

Optionally, the voltage divider circuit comprises a first resistor and a second resistor. The first resistor has its first terminal connected to the input voltage terminal and its second terminal connected to the control voltage input terminal. The second resistor has its first terminal connected to the control voltage input terminal and its second terminal connected to the second level terminal.

Optionally, the filter circuit comprises at least one capacitor having its first terminal connected to the control node and its second terminal connected to the second level terminal.

According to a second aspect of the present disclosure, a method for driving the circuit for removing residual image after power-off according to the above first aspect is provided. The method comprises: determining whether the voltage at the control voltage input terminal is higher than the voltage at the first level terminal, and when the voltage at the control voltage input terminal is higher than the voltage at the first level terminal: outputting, by the comparator, the high level voltage; aligning, by the control circuit, the voltage at the control node with the voltage at the second level terminal in response to the high level voltage outputted from the comparator; and outputting, by the output circuit, the voltage of the fifth level terminal at the signal output terminal in response to the voltage at the control node, or when the voltage at the control voltage input terminal is lower than or equal to the voltage at the first level terminal: outputting, by the comparator, the low level voltage; aligning, by the control circuit, the voltage at the control node with the voltage at the third level terminal in response to the low level voltage outputted from the comparator; and outputting, by the output circuit, the voltage of the fourth level terminal at the signal output terminal in response to the voltage at the control node. The voltage of the fourth level terminal is the high level voltage and the voltage of the fifth level terminal is the low level voltage.

According to a third aspect of the present disclosure, a display apparatus is provided. The display apparatus comprises the circuit for removing residual image after power-off according to the above first aspect.

Optionally, the display apparatus comprises a plurality of gate driving chips each connected to the signal output terminal of the circuit for removing residual image after power-off.

BRIEF DESCRIPTION OF THE DRAWINGS

In order to illustrate the solutions according to the embodiments of the present disclosure clearly, the figures used for description of the embodiments will be introduced briefly here. It is apparent to those skilled in the art that the figures described below only illustrate some embodiments of the present disclosure and other figures can be obtained from these figures without any inventive efforts.

DETAILED DESCRIPTION OF THE EMBODIMENTS

In the following, the solutions according to the embodiments of the present disclosure will be described clearly and fully with reference to the figures, such that these solutions can become more apparent to those skilled in the art. Obviously, the embodiments described below are only some, rather than all, of the embodiments. Starting from the embodiments of the present disclosure, those skilled in the art can obtain other embodiments without any inventive efforts. All these embodiments are to be encompassed by the scope of the present disclosure.

All the transistors used in the embodiments of the present disclosure may be Thin Film Transistors (TFTs) or Field Effect Transistors (FETs) or other devices having the same characteristics. The transistors used in the embodiments of the present disclosure are switching transistors, in accordance with their functions in circuits. The source and drain of each switching transistor used herein are interchangeable due to their symmetry. In the embodiments of the present disclosure, in order to distinguish between the two electrodes other than the gate in a transistor, the source may be referred to as a first electrode and the drain may be referred to as a second electrode. In each transistor shown in the figures, its middle terminal is the gate, its signal input terminal is the source and its signal output terminal is the drain. Further, the switching transistors used in the embodiments of the present disclosure include P-type switching transistors and N-type switching transistors. Each P-type switching transistor is turned on when its gate is at the low level and off when its gate is at the high level. Each N-type switching transistor is turned on when its gate is at the high level and off when its gate is at the low level.

It is also to be noted here that the terms "first", "second" and the like are used herein for distinguishing items having the same or similar functions or effects from each other, rather than limiting the number or sequence thereof.

First Embodiment

Figure 1:
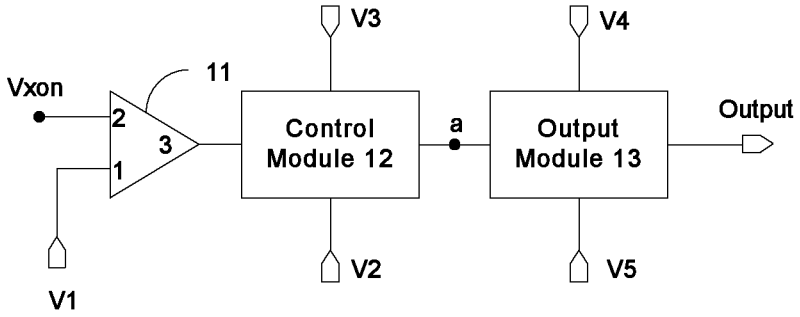
FIG. 1 is a first schematic diagram showing a structure of a circuit for removing residual image after power-off according to an embodiment of the present disclosure.

In this embodiment, a circuit for removing residual image after power-off is provided. Referring to FIG. 1, the circuit for removing residual image after power-off includes a comparator 11, a control circuit 12 and an output circuit 13.

The comparator 11 has an inverting terminal 1 connected to a first level terminal, V1, and a non-inverting terminal 2 connected to a control voltage input terminal, Vxon. The comparator 11 is configured to output a high level voltage at its output terminal 3 when an input voltage at the non-inverting terminal 2 is higher than an input voltage at the inverting terminal 1, or output a low level voltage at its output terminal 3 when the input voltage at the non-inverting terminal 2 is lower than or equal to the input voltage at the inverting terminal 1.

The control circuit 12 is connected to a second level terminal, V2, a third level terminal, V3, a control node, a, and the output terminal 3 of the comparator. The control circuit 12 is configured to align a voltage at the control node a with a voltage at the second level terminal V2 when the output terminal 3 of the comparator 11 outputs the high level voltage, and align the voltage at the control node a with a voltage at the third level terminal V3 when the output terminal 3 of the comparator 11 outputs the low level voltage.

The output circuit 13 is connected to a fourth level terminal, V4, a fifth level terminal, V5, a signal output terminal, Output, and the control node a. The output circuit 13 is configured to output a voltage of the fourth level terminal V4 at the signal output terminal when the voltage at the control node a is the voltage at the third level terminal V3, and output a voltage of the fifth level terminal V5 at the signal output terminal when the voltage at the control node a is the voltage at the second level terminal V2.

The voltage of the fourth level terminal V4 is the high level voltage and the voltage of the fifth level terminal V5 is the low level voltage.

It is to be noted here that, in the embodiments of the present disclosure, the high level voltage and the low level voltage are in relation to each other. The high level voltage and the low level voltage are used depending on TFTs in the circuit. A voltage is a high level voltage if it turns on an N-type transistor in the circuit when applied to the gate of the N-type transistor. On the other hand, a voltage is a low level voltage if it turns off an N-type transistor in the circuit when applied to the gate of the N-type transistor. Similarly, a voltage is a low level voltage if it turns on a P-type transistor when applied to the gate of the P-type transistor, or a high level voltage if it turns off a P-type transistor applied to the gate of the P-type transistor. The embodiments of the present disclosure are not limited to any specific value of the high or low level voltage, as long as it may satisfy the above on/off conditions of transistors. Preferably, the high level voltage may be higher than 5V. The high level voltage higher than 5V may fully turn on the TFTs in the display apparatus, so as to avoid any influence caused by the TFTs that are not fully turned on in the display apparatus.

The circuit for removing residual image after power-off according to the embodiment of the present disclosure includes a comparator, a control circuit and an output circuit. The comparator may output the high level at its output terminal when the input voltage at the non-inverting terminal is higher than the input voltage at the inverting terminal, or output the low level at its output terminal when the input voltage at the non-inverting terminal is lower than or equal to the input voltage at the inverting terminal. The control circuit may align the voltage at the control node with the voltage at the second level terminal when the output terminal of the comparator outputs the high level, and align the voltage at the control node with the voltage at the third level terminal when the output terminal of the comparator outputs the low level voltage. The output circuit may output the high level voltage of the fourth level terminal at the signal output terminal when the voltage at the control node is the voltage at the third level terminal, and output the low level voltage of the fifth level terminal at the signal output terminal when the voltage at the control node is the voltage at the second level terminal. That is, the circuit for removing residual image after power-off according to the embodiment of the present disclosure may output the low level voltage of the fifth level terminal at the signal output terminal when the control voltage input terminal is at the high level, or output the high level voltage of the fourth level terminal at the signal output terminal when the control voltage input terminal is at the low level. Compared with the solution in which a low-level control signal is inputted to the gate driving circuit upon power-off, the embodiment according to the present disclosure may input the high level voltage of the fourth level terminal to the gate driving circuit upon power-off. In this way, the embodiment according to the present disclosure can avoid the TFTs of the pixels to be turned off after being turned on, so as to achieve an improved effect of removal of residual image after power-off.

Figure 2:
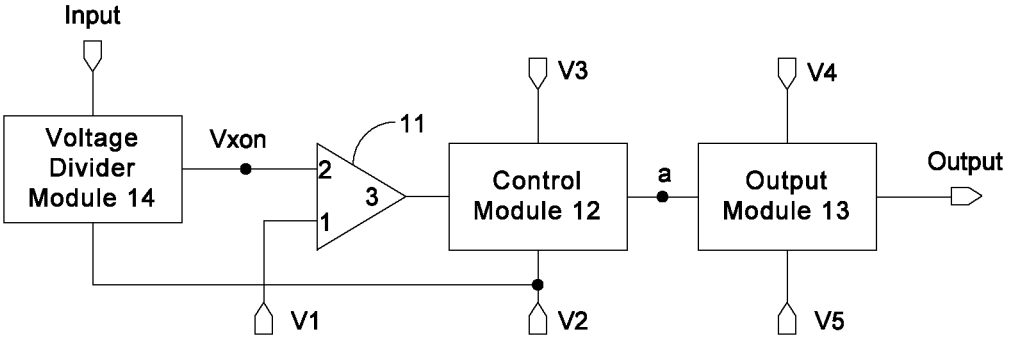
FIG. 2 is a second schematic diagram showing a structure of a circuit for removing residual image after power-off according to an embodiment of the present disclosure.

Optionally, referring to FIG. 2, the circuit for removing residual image after power-off according to the above embodiment of the present disclosure may further include a voltage divider circuit 14. The voltage divider circuit 14 is connected to an input voltage terminal, Input, the second level terminal V2 and the control voltage input terminal Vxon, and is configured to adjust the voltage at the control voltage input terminal Vxon.

In operation, in the above circuit for removing residual image after power-off, the voltage at the first level terminal V1 connected to the inverting terminal 1 of the comparator 11 has typically a fixed value. However, the circuit for removing residual image after power-off may have different input voltages to the input voltage terminal Input when applied to different products. Also, there may be different requirements on the voltage triggering changes in the output level from the output terminal 3 of the comparator 11 depending on operation environments. In the embodiment of the present disclosure, the voltage divider 14 is provided to divide and adjust the voltage inputted to the input terminal Input, such that the compatibility of the circuit for removing residual image after power-off can be improved. Meanwhile, it is possible to adjust the voltage triggering changes in the output level from the output terminal 3 of the comparator 11 depending on operation environments.

Figure 3:
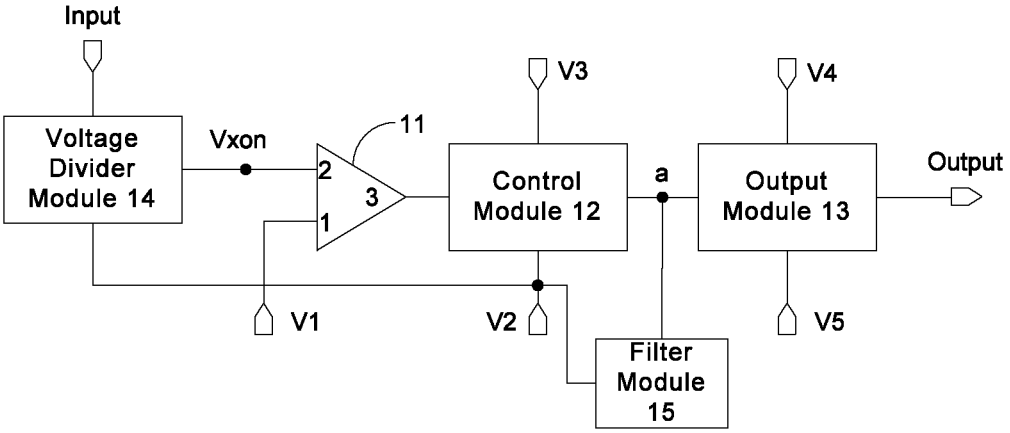
FIG. 3 is a third schematic diagram showing a structure of a circuit for removing residual image after power-off according to an embodiment of the present disclosure.

Further, optionally, referring to FIG. 3, the above circuit for removing residual image after power-off may further include a filter circuit 15. The filter circuit 15 is connected to the control node a and the second level terminal V2, and is configured to filter the voltage at the control node a.

The use of the circuit for removing residual image after power-off may be interfered by other electromagnetic signals, which may cause abnormities in the voltage at the control node a and in turn malfunctions of the circuit, resulting in abnormal display on the display apparatus. In the embodiment of the present disclosure, the filter circuit 15 is provided to filter the voltage at the control node a, so as to reduce the interference on the voltage at the control node a from the external electromagnetic signals, thereby avoiding malfunctions of the circuit for removing residual image after power-off.

Second Embodiment

In this embodiment of the present disclosure, a specific circuit diagram for the above circuit for removing residual image after power-off is provided.

Figure 4:
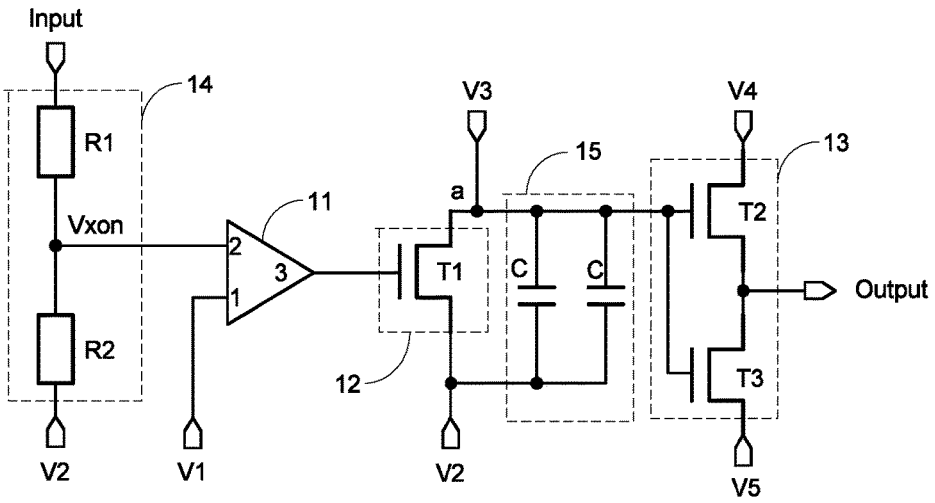
FIG. 4 is a first circuit diagram of a circuit for removing residual image after power-off according to an embodiment of the present disclosure.

In particular, as shown in FIG. 4, the control circuit 12 in the above embodiment includes a first transistor T1. The first transistor T1 has its first terminal connected to the control node a and the third level terminal V3, its second terminal connected to the second level terminal V2, and its gate connected to the output terminal 3 of the comparator 11.

The output circuit 13 includes a second transistor T2 and a third transistor T3.

The second transistor T2 has its first terminal connected to the fourth level terminal V4, its second terminal connected to the signal output terminal Output, and its gate connected to the control node a.

The third transistor T3 has its first terminal connected to the signal output terminal Output, its second terminal connected to the fifth level terminal V5, and its gate connected to the control node a.

Here, the second transistor T2 is an N-type transistor and the third transistor T3 is a P-type transistor. Alternatively, the second transistor T2 may be a P-type transistor and the third transistor T3 may be an N-type transistor.

The voltage divider circuit 14 includes a first resistor R1 and a second resistor R2.

The first resistor R1 has its first terminal connected to the input voltage terminal Input and its second terminal connected to the control voltage input terminal Vxon.

The second resistor R2 has its first terminal connected to the control voltage input terminal Vxon and its second terminal connected to the second level terminal V2.

The filter circuit 15 includes at least one capacitor C having its first terminal connected to the control node a and its second terminal connected to the second level terminal V2.

In the example shown in FIG. 4, the filter circuit 15 includes two capacitors. However, the embodiment of the present disclosure is not limited to this. In the embodiment of the present disclosure, the filter circuit 15 may include any other number of capacitors, e.g., 1, 3 or the like.

In the following, the operation principle of the circuit for removing residual image after power-off according to the above embodiment will be explained with reference to the circuit for removing residual image after power-off shown in FIG. 4, in which each of the first transistor T1 and the second transistor T2 is an N-type transistor that is turned on when its gate is at the high level and off when its gate is at the low level, and the third transistor T3 is a P-type transistor that is turned on when its gate is at the low level and off when its gate is at the high level. Here, each of the first level terminal V1, the second level terminal V2, the third level terminal V3, the fourth level terminal V4 and the fifth level terminal V5 provides a stable voltage. The third level terminal V3 and the fourth level terminal V4 each provide a high level voltage, and the second level terminal V2 and the fifth level terminal V5 each provide a low level voltage. In an example, the voltage at the fourth level terminal V4 may be a common voltage, Vcom, in the display apparatus or an output voltage, Vin, from a main power supply of an analog circuit, and the voltage at the second level terminal V2 may be a ground voltage.

First, when the display apparatus is operating normally, a high level is inputted at Input. The input voltage at Input is divided by the resistors R1 and R2, and the resulting voltage at the control voltage input terminal Vxon is:

$$V_{xon} = \frac{(V_{in} - V_2) \cdot R1}{R1 + R2}$$

where $V_{xon}$ is the voltage at the control voltage input terminal Vxon, $V_{in}$ is the input voltage at the input voltage terminal Input, $V_2$ is the output voltage value at the second level terminal V2, R1 is the resistance value of the first resistor R1, and R2 is the resistance value of the second resistor R2.

In this case, the output voltage at the first level terminal V1 is set such that $V_{xon}$ is higher than the output voltage at the first level terminal V1, the input voltage $V_{xon}$ at the non-inverting terminal 2 of the comparator 11 is higher than the input voltage at the inverting terminal 1 of the comparator 11, and the output terminal 3 of the comparator outputs the high level. T1 is turned on as it is an N-type transistor that is turned on when its gate is at the high level. The control node a is connected to the second level terminal via T1 and is at the low level. Meanwhile, the capacitor C in the filter circuit may absorb the interference voltage due to electromagnetic interferences, such that the control node a may be maintained at a stable level. Since the control node a is at the low level, the second transistor T2 is an N-type transistor that is turned on when its gate is at the high level and the third transistor T3 is a P-type transistor that is turned off when its gate is at the high level, T3 is on and T2 is off. The voltage of the fifth level terminal V5 is outputted at Output. That is, when the display apparatus is operating normally, the low level is outputted at Output and the circuit for removing residual image after power-off has no effect.

When the display apparatus is powered off, the voltage at the input voltage terminal Input decreases gradually. After division of the input voltage $V_{in}$ at Input by R1 and R2, the voltage $V_{xon}$ at the control voltage input terminal Vxon is further reduced. When the voltage $V_{xon}$ at the control voltage input terminal Vxon is lower than or equal to the output voltage at the first level terminal V1, the input voltage $V_{xon}$ at the non-inverting terminal 2 of the comparator 11 is lower than or equal to the input voltage V1 at the inverting terminal 1 of the comparator 11, and the output terminal 3 of the comparator outputs the low level. The first transistor T1 is turned off, and the control node a is disconnected from the second level terminal V2. Accordingly, the control node a outputs the voltage at the third level terminal V3 and the control node a is at the high level. Since the control node a is at the high level, T2 is turned on and T3 is turned off, and the high level voltage of the fourth level terminal V4 is outputted at Output. That is, when the display apparatus is powered off, the high level is outputted at Output, and the circuit for removing residual image after power-off outputs a high level for controlling the gate driving circuit to turn on TFTs of the respective pixels. Hence, the embodiment of the present disclosure can avoid the TFTs in the pixels to be turned off after being turned on, so as to achieve an improved effect of removal of residual image after power-off.

Further, in order to avoid the output voltages from the respective level terminals being too high to damage the components in the circuit, in the above embodiment, the output voltages from the respective level terminals may be divided using resistors before outputting to the circuit for removing residual image after power-off. In particular, a resistor may be connected in series between the third level terminal V3 and the control node a, and/or a resistor may be connected in series between the fourth level terminal V4 and the output terminal Output.

Third Embodiment

In this embodiment of the present disclosure, another specific circuit diagram for the above circuit for removing residual image after power-off is provided.

Figure 5:
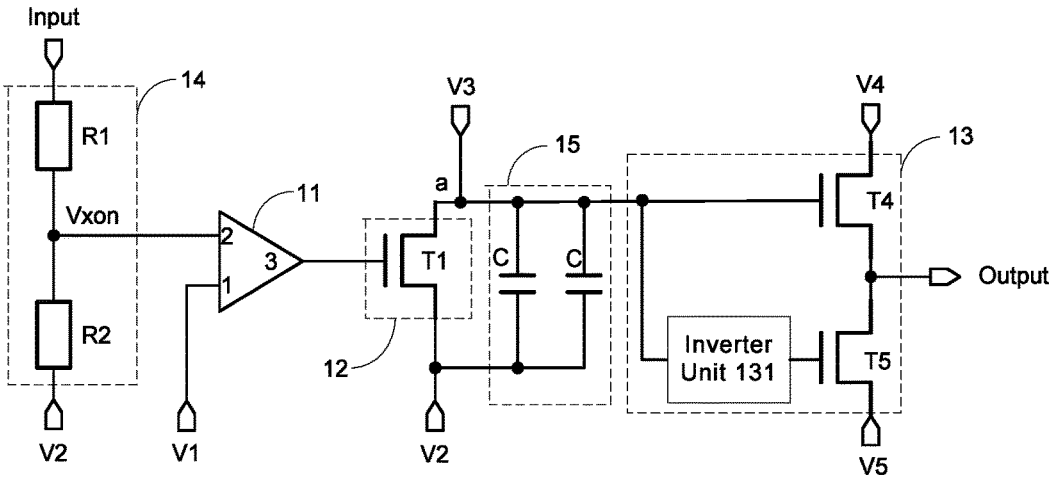
FIG. 5 is a second circuit diagram of a circuit for removing residual image after power-off according to an embodiment of the present disclosure.

In particular, as shown in FIG. 5, the control circuit 12, the voltage divider circuit 14 and the filter circuit 15 are the same as those in the second embodiment and the details thereof will thus be omitted here. This embodiment differs from the second embodiment in that the output circuit 13 includes an inverter circuit 131, a fourth transistor T4 and a fifth transistor T5.

The inverter circuit 131 has its input terminal connected to the control node a and its output terminal connected to the gate of the fifth transistor T5. The inverter circuit 131 is configured to output a voltage at its output terminal that has an opposite phase to a voltage inputted at its input terminal.

The fourth transistor T4 has its first terminal connected to the fourth level terminal V4 and its second terminal connected to the signal output terminal Output, and its gate connected to the control node a.

The fifth transistor T5 has its first terminal connected to the signal output terminal Output, its second terminal connected to the fifth level terminal V5, and its gate connected to the output terminal of the inverter circuit.

Each of the fourth and fifth transistors is an N-type transistor.

In the following, the operation principle of the circuit for removing residual image after power-off according to the above embodiment will be explained with reference to the circuit for removing residual image after power-off shown in FIG. 5, in which the first transistor T1 is an N-type transistor that is turned on when its gate is at the high level and off when its gate is at the low level. Here, each of the first level terminal V1, the second level terminal V2, the third level terminal V3, the fourth level terminal V4 and the fifth level terminal V5 provides a stable voltage. The third level terminal V3 and the fourth level terminal V4 each provide a high level voltage, and the second level terminal V2 and the fifth level terminal V5 each provide a low level voltage. In an example, the voltage at the fourth level terminal V4 may be a common voltage, Vcom, in the display apparatus or an output voltage, Vin, from a main power supply of an analog circuit, and the voltage at the second level terminal V2 may be a ground voltage.

First, when the display apparatus is operating normally, the voltage at the control voltage input terminal Vxon is:

$$V_{xon} = \frac{(V_{in} - V_2) \cdot R1}{R1 + R2}$$

where $V_{xon}$ is the voltage at the control voltage input terminal Vxon, $V_{in}$ is the input voltage at the input voltage terminal Input, $V_2$ is the output voltage value at the second level terminal V2, R1 is the resistance value of the first resistor R1, and R2 is the resistance value of the second resistor R2.

In this case, the output voltage at the first level terminal V1 is set such that $V_{xon}$ is higher than the output voltage at the first level terminal V1, the input voltage $V_{xon}$ at the non-inverting terminal 2 of the comparator 11 is higher than the input voltage at the inverting terminal 1 of the comparator 11, and the output terminal 3 of the comparator outputs the high level. T1 is turned on as it is an N-type transistor that is turned on when its gate is at the high level. The control node a is connected to the second level terminal via T1 and is at the low level. Meanwhile, the capacitor C in the filter circuit may absorb the interference voltage due to electromagnetic interferences, such that the control node a may be maintained at a stable level. Since the control node a is at the low level, the input terminal of the inverter circuit 131 is at the low level, the output terminal of the inverter circuit 131 is at the high level, T4 is off and T5 is on. The low level of the fifth level terminal V5 is outputted at Output. That is, when the display apparatus is operating normally, the low level is outputted at Output and the circuit for removing residual image after power-off has no effect.

When the display apparatus is powered off, the voltage at the input voltage terminal Input decreases gradually. After division of the input voltage $V_{in}$ at Input by R1 and R2, the voltage $V_{xon}$ at the control voltage input terminal Vxon is further reduced. When the voltage $V_{xon}$ at the control voltage input terminal Vxon is lower than or equal to the output voltage at the first level terminal V1, the input voltage $V_{xon}$ at the non-inverting terminal 2 of the comparator 11 is lower than or equal to the input voltage V1 at the inverting terminal 1 of the comparator 11, and the output terminal 3 of the comparator outputs the low level. The first transistor T1 is turned off, and the control node a is disconnected from the second level terminal V2. Accordingly, the control node a outputs the voltage at the third level terminal V3 and the control node a is at the high level. Since the control node a is at the high level, the input terminal of the inverter circuit 131 is at the high level, the output terminal of the inverter circuit 131 is at the low level, T4 is turned on and T5 is turned off, and the high level voltage of the fourth level terminal V4 is outputted at Output. That is, when the display apparatus is powered off, the high level is outputted at Output, and the circuit for removing residual image after power-off outputs a high level for controlling the gate driving circuit to turn on the TFTs of the respective pixels. Hence, the embodiment of the present disclosure can avoid the TFTs in the pixels to be turned off after being turned on, so as to achieve an improved effect of removal of residual image after power-off.

In the above embodiment, the inverter circuit 131 may be an inverter or an OR gate. The inverter is typically used in analog circuits, and the OR gate is typically used in digital circuits. They are common in that they both may invert the phase of the input signal by 180 degrees and output it at its output terminal.

Figure 6:
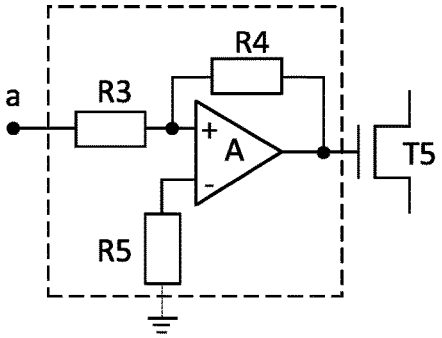
FIG. 6 is a circuit diagram of an inverter according to an embodiment of the present disclosure.

For example, the inverter in the above embodiment may include, as shown in FIG. 6, an inverting circuit A, a third resistor R3, a fourth resistor R4 and a fifth resistor R5. The third resistor R3 has its first terminal connected to the control node a and its second terminal connected to a first input terminal of the inverting circuit A. The fourth resistor R4 has its first terminal connected to the second terminal of the third resistor R3 and its second terminal connected to an output terminal of the inverting circuit A. The fifth resistor R5 has its first terminal connected to a second input terminal of the inverting circuit A and its second terminal grounded. The inverting circuit A has its output terminal connected to the gate of the fifth transistor T5.

In the circuit of the inverter, we have:

$$I_3 = I_4,\ V_0 = -\frac{R4}{R3}V_i$$

where $I_3$ is the current flowing through the third resistor R3, $I_4$ is the current flowing through the third resistor R4, $V_o$ is the output voltage of the inverter, $R_3$ is the resistance value of the third resistor, $R_4$ is the resistance value of the fourth resistor R4, and $V_i$ is the voltage at the control node a. With the above inverter circuit, the inverted voltage of the input voltage $V_i$ may be outputted, and the resistance values of the resistors may be adjusted as desired, so as to adjust the value of the output voltage $V_o$.

Fourth Embodiment

In this embodiment of the present disclosure, another specific circuit diagram for the above circuit for removing residual image after power-off is provided.

Figure 7:
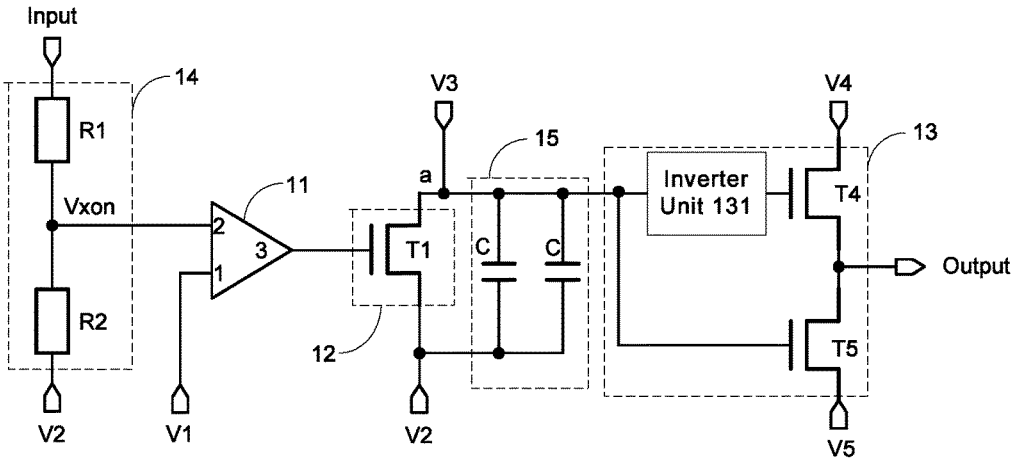
FIG. 7 is a third circuit diagram of a circuit for removing residual image after power-off according to an embodiment of the present disclosure.

In particular, as shown in FIG. 7, the control circuit 12, the voltage divider circuit 14 and the filter circuit 15 are the same as those in the second embodiment and the details thereof will thus be omitted here. This embodiment differs from the second embodiment in that the output circuit 13 includes an inverter circuit 131, a fourth transistor T4 and a fifth transistor T5.

The inverter circuit 131 has its input terminal connected to the control node a and its output terminal connected to the gate of the fourth transistor T4. The inverter circuit 131 is configured to output a voltage at its output terminal that has an opposite phase to a voltage inputted at its input terminal.

The fourth transistor T4 has its first terminal connected to the fourth level terminal V4, its second terminal connected to the signal output terminal Output, and its gate connected to the output terminal of the inverter circuit 131.

The fifth transistor T5 has its first terminal connected to the signal output terminal Output, its second terminal connected to the fifth level terminal V5, and its gate connected to control node a.

Here, each of the fourth and fifth transistors is a P-type transistor.

The operation principle of the circuit for removing residual image after power-off according to this embodiment is similar with that of the circuit for removing residual image after power-off according to the third embodiment, with the following differences. When the display apparatus is operating normally, the control node a is at the low level, the gate of the fourth transistor T4 is at the high level, and the gate of the fifth transistor T5 is at the low level, Thus, T4 is off and T5 is on, and the low level of the fifth level terminal V5 is outputted at Output. When the display apparatus is powered off, the control node a is at the high level, the gate of the fourth transistor T4 is at the low level, and the gate of the fifth transistor T5 is at the high level, Thus, T4 is turned on and T5 is turned off, and the high level of the fourth level terminal V4 is outputted at Output. That is, when the display apparatus is operating normally, the low level is outputted at Output and the circuit for removing residual image after power-off has no effect. When the display apparatus is powered off, the high level is outputted at Output, and the circuit for removing residual image after power-off outputs a high level for controlling the gate driving circuit to turn on TFTs of the respective pixels. Hence, the embodiment of the present disclosure can avoid the TFTs in the pixels to be turned off after being turned on, so as to achieve an improved effect of removal of residual image after power-off.

Further, in accordance with the manufacture process of TFTs, different types of TFTs require different dopant materials in their active layers. Hence, it is preferred to adopt TFTs of the same type in the circuit for removing residual image after power-off, which is advantageous to the manufacture process of the circuit. Hence, preferably TFTs of the same type may be used for implementation of the present disclosure.

Also, in this embodiment, the inverter circuit 131 may be an inverter or an OR gate. The circuit diagram of the inverter may be the same as FIG. 6.

Fifth Embodiment

Figure 8:
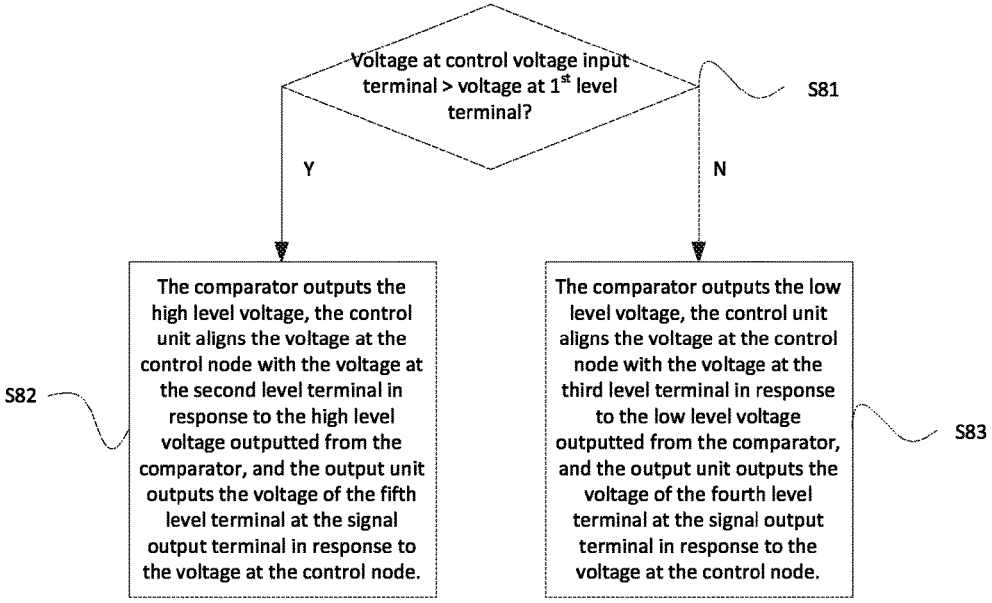
FIG. 8 is a flowchart illustrating a method for driving a circuit for removing residual image after power-off according to an embodiment of the present disclosure.

In this embodiment, a method for driving the circuit for removing residual image after power-off according to any of the above embodiments is provided. In particular, referring to FIG. 8, the method includes the following steps.

At block S81, it is determined whether the voltage at the control voltage input terminal is lower than the voltage at the first level terminal.

The method proceeds with block S82 if the voltage at the control voltage input terminal is higher than the voltage at the first level terminal in the block S81, or with block S83 if the voltage at the control voltage input terminal is lower than or equal to the voltage at the first level terminal in the block S81.

At block S82, the comparator outputs the high level voltage, the control circuit aligns the voltage at the control node with the voltage at the second level terminal in response to the high level voltage outputted from the comparator, and the output circuit outputs the voltage of the fifth level terminal at the signal output terminal in response to the voltage at the control node.

At block S83, the comparator outputs the low level voltage, the control circuit aligns the voltage at the control node with the voltage at the third level terminal in response to the low level voltage outputted from the comparator, and the output circuit outputs the voltage of the fourth level terminal at the signal output terminal in response to the voltage at the control node.

Here, the voltage of the fourth level terminal is the high level voltage and the voltage of the fifth level terminal is the low level voltage.

With the method for driving the circuit for removing residual image after power-off according to the embodiment of the present disclosure, when the voltage at the control voltage input terminal is higher than the voltage at the first level terminal, the comparator outputs the high level voltage, the control circuit aligns the voltage at the control node with the voltage at the second level terminal in response to the high level voltage outputted from the comparator, and the output circuit outputs the low level voltage of the fifth level terminal at the signal output terminal in response to the voltage at the control node, so as to ensure the normal operation of the display apparatus. On the other hand, when the voltage at the control voltage input terminal is lower than or equal to the voltage at the first level terminal, the comparator outputs the low level voltage, the control circuit aligns the voltage at the control node with the voltage at the third level terminal in response to the low level voltage outputted from the comparator, and the output circuit outputs the high level voltage of the fourth level terminal at the signal output terminal in response to the voltage at the control node. As such, the embodiment of the present disclosure may input the high level voltage of the fourth level terminal to the gate driving circuit when the display apparatus is powered off. In this way, the embodiment of the present disclosure can avoid the TFTs in the pixels to be turned off after being turned on, so as to achieve an improved effect of removal of residual image after power-off.

Sixth Embodiment

In this embodiment of the present disclosure, a display apparatus is provided. The display apparatus includes the circuit for removing residual image after power-off according to any of the above embodiments.

For example, the display apparatus may be e-paper, a mobile phone, a tablet computer, a television, a display, a notebook computer, a digital frame, a navigator, or any other product or component having a display function.

Figure 9:
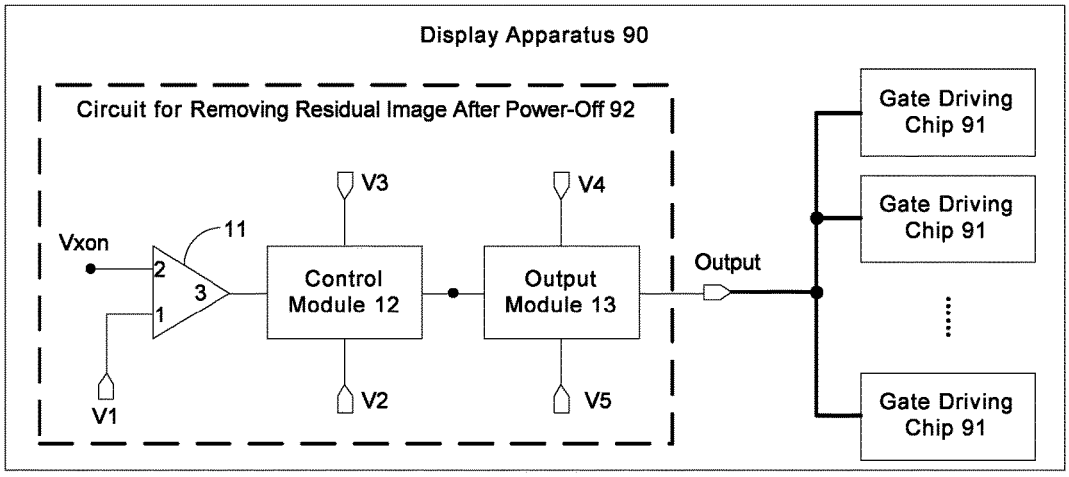
FIG. 9 is a schematic diagram showing a display apparatus according to an embodiment of the present disclosure.

Further, as shown in FIG. 9, the display apparatus 90 may include a plurality of gate driving chips 91 each connected to the signal output terminal Output of the same circuit 92 for removing residual image after power-off.

By connecting the plurality of gate driving chips to the signal output terminal of the same circuit for removing residual image after power-off, the output current from the signal output terminal of the circuit may be divided, so as to avoid the output current from the signal output terminal of the circuit being too high to damage the components in the display apparatus. In this way, the reliability of the display apparatus can be improved.

It can be appreciated that the above embodiments are exemplary only, rather than limiting the scope of the present disclosure. Various modifications or alternatives can be made by those skilled in the art without departing from the spirit and scope of the present disclosure. These modifications and alternatives are to be encompassed by the scope of the present disclosure, which is defined only by the claims as attached.

What is claimed is:

1. A circuit for removing residual image after power-off, comprising:

a comparator having an inverting terminal connected to a first level terminal and a non-inverting terminal connected to a control voltage input terminal for receiving a voltage of a main power supply of a display apparatus, and configured to output a high level voltage at its output terminal when an input voltage at the non-inverting terminal is higher than an input voltage at the inverting terminal, or output a low level voltage at its output terminal when the input voltage at the non-inverting terminal is lower than or equal to the input voltage at the inverting terminal;

a control circuit connected to a second level terminal, a third level terminal, a control node and the output terminal of the comparator, and configured to align a voltage at the control node with a voltage at the second level terminal when the output terminal of the comparator outputs the high level voltage, and align the voltage at the control node with a voltage at the third level terminal when the output terminal of the comparator outputs the low level voltage; and an output circuit connected to a fourth level terminal, a fifth level terminal, a signal output terminal for outputting a control signal of a gate driving circuit of the display apparatus, and the control node, and configured to output a voltage of the fourth level terminal at the signal output terminal when the voltage at the control node is the voltage at the third level terminal, and output a voltage of the fifth level terminal at the signal output terminal when the voltage at the control node is the voltage at the second level terminal, wherein the voltage of the fourth level terminal is the high level voltage and the voltage of the fifth level terminal is the low level voltage, and wherein each of the first level terminal, the second level terminal, the third level terminal, the fourth level terminal and the fifth level terminal provides a stable voltage that is independent of the voltage of the main power supply of the display apparatus.

2. The circuit of claim 1, further comprising: a voltage divider circuit connected to an input voltage terminal, the second level terminal and the control voltage input terminal, and configured to adjust the voltage at the control voltage input terminal.

3. The circuit of claim 2, wherein the voltage divider circuit comprises a first resistor and a second resistor, wherein:

the first resistor has its first terminal connected to the input voltage terminal and its second terminal connected to the control voltage input terminal, and the second resistor has its first terminal connected to the control voltage input terminal and its second terminal connected to the second level terminal.

4. The circuit of claim 2, wherein the output circuit comprises a second transistor and a third transistor, wherein:

the second transistor has its first terminal connected to the fourth level terminal, its second terminal connected to the signal output terminal, and its gate connected to the control node, the third transistor has its first terminal connected to the signal output terminal, its second terminal connected to the fifth level terminal, and its gate connected to the control node, and the second transistor is an N-type transistor and the third transistor is a P-type transistor.

5. The circuit of claim 2, wherein the output circuit comprises an inverter circuit, a fourth transistor and a fifth transistor, wherein:

the inverter circuit has its input terminal connected to the control node and its output terminal connected to the gate of the fourth transistor, and is configured to output a voltage at its output terminal that has an opposite phase to a voltage inputted at its input terminal, the fourth transistor has its first terminal connected to the fourth level terminal, its second terminal connected to the signal output terminal, and its gate connected to the output terminal of the inverter circuit, the fifth transistor has its first terminal connected to the signal output terminal, its second terminal connected to the fifth level terminal, and its gate connected to the control node, and each of the fourth and fifth transistors is a P-type transistor.

6. The circuit of claim 5, wherein the inverter circuit comprises an inverter or an OR gate.

7. The circuit of claim 2, wherein the output circuit comprises an inverter circuit, a fourth transistor and a fifth transistor, wherein:

the inverter circuit has its input terminal connected to the control node and its output terminal connected to the gate of the fifth transistor, and is configured to output a voltage at its output terminal that has an opposite phase to a voltage inputted at its input terminal, the fourth transistor has its first terminal connected to the fourth level terminal, its second terminal connected to the signal output terminal, and its gate connected to the control node, the fifth transistor has its first terminal connected to the signal output terminal, its second terminal connected to the fifth level terminal, and its gate connected to the output terminal of the inverter circuit, and each of the fourth and fifth transistors is an N-type transistor.

8. The circuit of claim 7, wherein the inverter circuit comprises an inverter or an OR gate.

9. The circuit of claim 1, further comprising: a filter circuit connected to the control node and the second level terminal, and configured to filter the voltage at the control node.

10. The circuit of claim 9, wherein the filter circuit comprises at least one capacitor having its first terminal connected to the control node and its second terminal connected to the second level terminal.

11. The circuit of claim 1, wherein the control circuit comprises: a first transistor having its first terminal connected to the control node and the third level terminal, its second terminal connected to the second level terminal, and its gate connected to the output terminal of the comparator.

12. The circuit of claim 1, wherein the output circuit comprises a second transistor and a third transistor, wherein:

the second transistor has its first terminal connected to the fourth level terminal, its second terminal connected to the signal output terminal, and its gate connected to the control node, the third transistor has its first terminal connected to the signal output terminal, its second terminal connected to the fifth level terminal, and its gate connected to the control node, and the second transistor is an N-type transistor and the third transistor is a P-type transistor.

13. The circuit of claim 1, wherein the output circuit comprises an inverter circuit, a fourth transistor and a fifth transistor, wherein:

the inverter circuit has its input terminal connected to the control node and its output terminal connected to the gate of the fourth transistor, and is configured to output a voltage at its output terminal that has an opposite phase to a voltage inputted at its input terminal, the fourth transistor has its first terminal connected to the fourth level terminal its second terminal connected to the signal output terminal, and its gate connected to the output terminal of the inverter circuit, the fifth transistor has its first terminal connected to the signal output terminal, its second terminal connected to the fifth level terminal, and its gate connected to the control node, and each of the fourth and fifth transistors is a P-type transistor.

14. The circuit of claim 13, wherein the inverter circuit comprises an inverter or an OR gate.

15. The circuit of claim 1, wherein the output circuit comprises an inverter circuit, a fourth transistor and a fifth transistor, wherein:

the inverter circuit has its input terminal connected to the control node and its output terminal connected to the gate of the fifth transistor, and is configured to output a voltage at its output terminal that has an opposite phase to a voltage inputted at its input terminal, the fourth transistor has its first terminal connected to the fourth level terminal, its second terminal connected to the signal output terminal, and its gate connected to the control node, the fifth transistor has its first terminal connected to the signal output terminal its second terminal connected to the fifth level terminal, and its gate connected to the output terminal of the inverter circuit, and each of the fourth and fifth transistors is an N-type transistor.

16. The circuit of claim 15, wherein the inverter circuit comprises an inverter or an OR gate.

17. A method for driving the circuit for removing residual image after power-off according to claim 1, comprising:

determining whether the voltage at the control voltage input terminal is higher than the voltage at the first level terminal, in response to determining that the voltage at the control voltage input terminal is higher than the voltage at the first level terminal:

outputting, by the comparator, the high level voltage;

aligning, by the control circuit, the voltage at the control node with the voltage at the second level terminal in response to the high level voltage outputted from the comparator; and outputting, by the output circuit, the voltage of the fifth level terminal at the signal output terminal in response to the voltage at the control node, and in response to determining that the voltage at the control voltage input terminal is lower than or equal to the voltage at the first level terminal:

outputting, by the comparator, the low level voltage;

aligning, by the control circuit, the voltage at the control node with the voltage at the third level terminal in response to the low level voltage outputted from the comparator; and outputting, by the output circuit, the voltage of the fourth level terminal at the signal output terminal in response to the voltage at the control node, wherein the voltage of the fourth level terminal is the high level voltage and the voltage of the fifth level terminal is the low level voltage.

18. A display apparatus, comprising the circuit for removing residual image after power-off according to claim 1.

19. The display apparatus of claim 18, comprising a plurality of gate driving chips each connected to the signal output terminal of the circuit for removing residual image after power-off.

* * * * *